US006675507B2

(12) United States Patent
Petruzzelli

(10) Patent No.: US 6,675,507 B2
(45) Date of Patent: Jan. 13, 2004

(54) ARTICULATED SNOW SHOVEL

(76) Inventor: Rocco Petruzzelli, 2 Lady Godiva Way, New City, NY (US) 10956

( * ) Notice: Subject to any disclaimer, the term of this patent is extended or adjusted under 35 U.S.C. 154(b) by 0 days.

(21) Appl. No.: 10/117,609

(22) Filed: Apr. 5, 2002

(65) Prior Publication Data

US 2003/0188462 A1 Oct. 9, 2003

(51) Int. Cl.[7] ..... E01H 5/02
(52) U.S. Cl. ..... 37/284; 294/54.5
(58) Field of Search ..... 37/8, 283, 284, 37/285; 294/51, 53.5, 54.5, 57

(56) References Cited

U.S. PATENT DOCUMENTS 2,803,071 A * 8/1957 Pochopien ..... 37/283
2,811,792 A * 11/1957 Cork, Jr. ..... 37/284
2,967,363 A * 1/1961 Meier ..... 37/283
4,258,485 A * 3/1981 Gof ..... 37/283
4,910,893 A * 3/1990 Asay ..... 37/281
6,457,757 B2 * 10/2002 Hendrick ..... 294/54.5

* cited by examiner

*Primary Examiner*—Robert E. Pezzuto
(74) *Attorney, Agent, or Firm*—Notaro & Michalos P.C.

(57) ABSTRACT

A shovel has an articulated shovel blade for pivoting movement relative to a wheeled carriage on which the blade is mounted. The shovel blade is adjustably locked in position at different angles relative to the direction of travel of the carriage, for pushing snow or other material to the side of the shovel as it travels across the ground. The carriage is pushed forward using a handle or a motor is provided for self-propelling the carriage.

9 Claims, 5 Drawing Sheets

ARTICULATED SNOW SHOVEL

FIELD AND BACKGROUND OF THE INVENTION

The present invention relates generally to the field of manual tools for snow removal and in particular to a new and useful snow shovel having an articulating shovel blade mounted to a carriage.

Snow shovels having a blade and an elongated handle are generally well known in the art of snow removal tools. Some snow shovels have sharply curved blades, while others are flattened, and still others have side panels.

Two types of shovel are particularly common, regardless of the specific blade or handle. One type is used to lift snow and throw it, while the other type of shovel is used primarily to push snow in front of it like a plow.

It is also generally well known that some types of snow can be particularly heavy, such as wet, slushy snow or icy snow. Attempting to shovel a walkway or driveway covered with wet snow can be difficult for many people because of the weight.

Many different solutions have been provided for making shoveling easier. Some of the solutions include adding a handle to a conventional single handle shovel, such as disclosed by U.S. Pat. No. 6,343,822. U.S. Pat. No. 6,343,822 teaches a shovel with a second, adjustable handle which can be moved from side to side around the main handle shaft to provide leverage for lifting snow or other material with the shovel.

Other patents disclose handles and blades which pivot relative to each other. U.S. Pat. No. 6,290,273, for example, describes a shovel with a blade that pivots to a greater or lesser angle between the blade surface and the handle. That is, the shovel blade pivots up and down about a horizontal axis.

U.S. Pat. No. 5,984,393 teaches a shovel having a fixed second handle near the shovel blade, and a mechanism for allowing the shovel blade to pivot about the main handle. The shovel blade is locked from pivoting until a load of snow has been lifted and is ready to be dumped. Then, a trigger is used to allow the blade to pivot to one side or the other so that the snow is dumped without having to twist the shovel handles.

U.S. Pat. No. 813,983 discloses a shovel with the shovel blade pivotally attached to the handle so that the blade can tilt to the left or right. The blade is connected to the handle by two bolts or screws arranged vertically aligned. The upper bolt is mounted through an arcuate slot in the shovel blade, while the lower bolt is the pivot point. Thus, the edges of the blade can be tilted off horizontal, theoretically to cause snow to move to one side when the shovel is used as a plow. However, it appears that if the bottom edge is not flat, some snow would remain behind when using the shovel in this manner.

A scoop shovel having the scoop blade horizontally pivotable about a vertical shaft axis is taught by U.S. Pat. No. 2,221,219. The scoop is moved by a ratchet and pawl mechanism connected to a remote lever at the end of the handle shaft. The scoop is pivotable for use scooping out ashes from a furnace having a small door, whereby the shovel can be inserted through the furnace door, pivoted, ashes scooped up and the scoop pivoted back for removal from the furnace.

A snow plow type shovel having an expandable pushing blade is disclosed by U.S. Pat. No. 6,269,558. The blade has two adjustable wings connected to form a "V" with a flat bottom where the handle is attached. The wings can be pivoted to form a greater or smaller acute angle relative to the handle.

U.S. Pat. No. 6,334,640 discloses a snow shovel having a rotating handle and a single wheel. The handle and wheel are connected to the center of the rear of the shovel blade, so that the shovel is symmetrical about a horizontal axis through the center. The handle can be rotated around the wheel so that the shovel can be flipped over to permit the other edge of the shovel blade to contact the ground. The blade does not pivot horizontally relative to the wheel or handle.

Each of the shovels having a pivoting blade still has the easiest direction of travel with the shovel being perpendicular to the surface of the shovel blade. Alternatively, these shovels result in the handle being positioned at an odd angle when the shovel blade is placed square on the ground, so that it will be difficult to move the shovel. That is, none of the prior shovels provides a means for angling the blade relative to the direction of movement of the shovel blade, so that it can truly act as a plow.

SUMMARY OF THE INVENTION

It is an object of the present invention to provide a shovel having a pivoting blade for moving snow from a sidewalk or driveway.

It is a further object of the invention to provide a shovel with an adjustably pivoted blade.

Yet another object of the invention is to provide a wheeled shovel for more easily pushing snow off a driveway or sidewalk.

Accordingly, a shovel is provided having an articulated shovel blade pivotally attached to a wheeled carriage. The shovel blade can be locked into three or more positions at different angles relative to a support bar of the carriage. The shovel blade is pivotally mounted to the support bar with a bracket so that the blade is spaced from the support bar and wheels of the carriage. A locking pin passing through the bracket and support bar is used to hold the bracket in position relative to the support bar. A handle extends upwardly from the support bar so that a person using the shovel can push it easily in a direction perpendicular to the support bar, even while the shovel blade is angled relative to the support bar.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
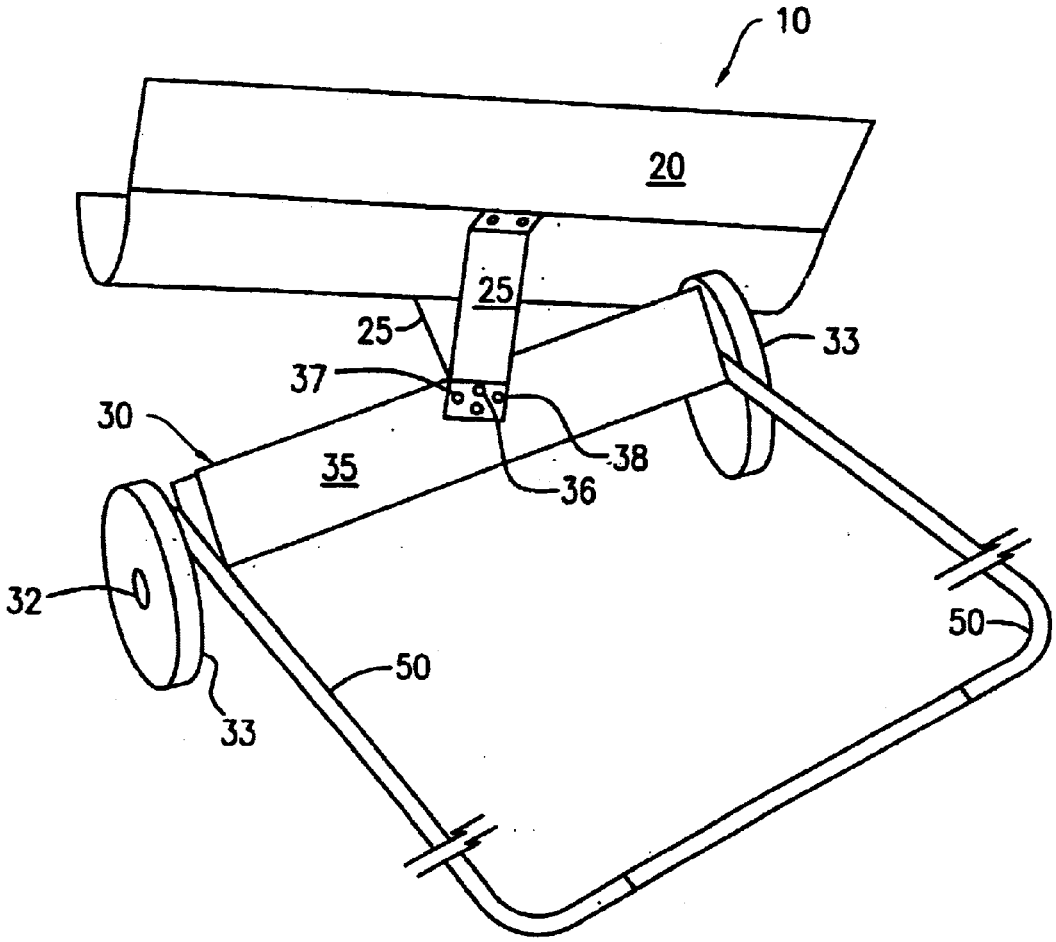
FIG. 1 is a top, rear perspective view of a snow shovel according to the invention.

Referring now to the drawings, in which like reference numerals are used to refer to the same or similar elements, FIG. 1 shows an articulated shovel 10 of the invention with the handle 50 shown having a truncated length. The articulated shovel 10 has a pivotable shovel blade 20 connected to a support bar 35 of a carriage 30. A bracket 25 pivotally secures the shovel blade 20 to the support bar 35. The bracket 25 is joined to the support bar at pivot joint 36. The other ends of the bracket 25 are riveted, welded or fastened with threaded fasteners to the shovel blade 20.

The carriage 30 includes support bar 35 extending between a pair of wheels 33 attached to the support bar 35 by axles 32. A handle 50 extends upwardly and to the rear from either side of the support bar 35 in an inverted "U" for pushing the carriage 30 and shovel blade 20.

Figure 2:
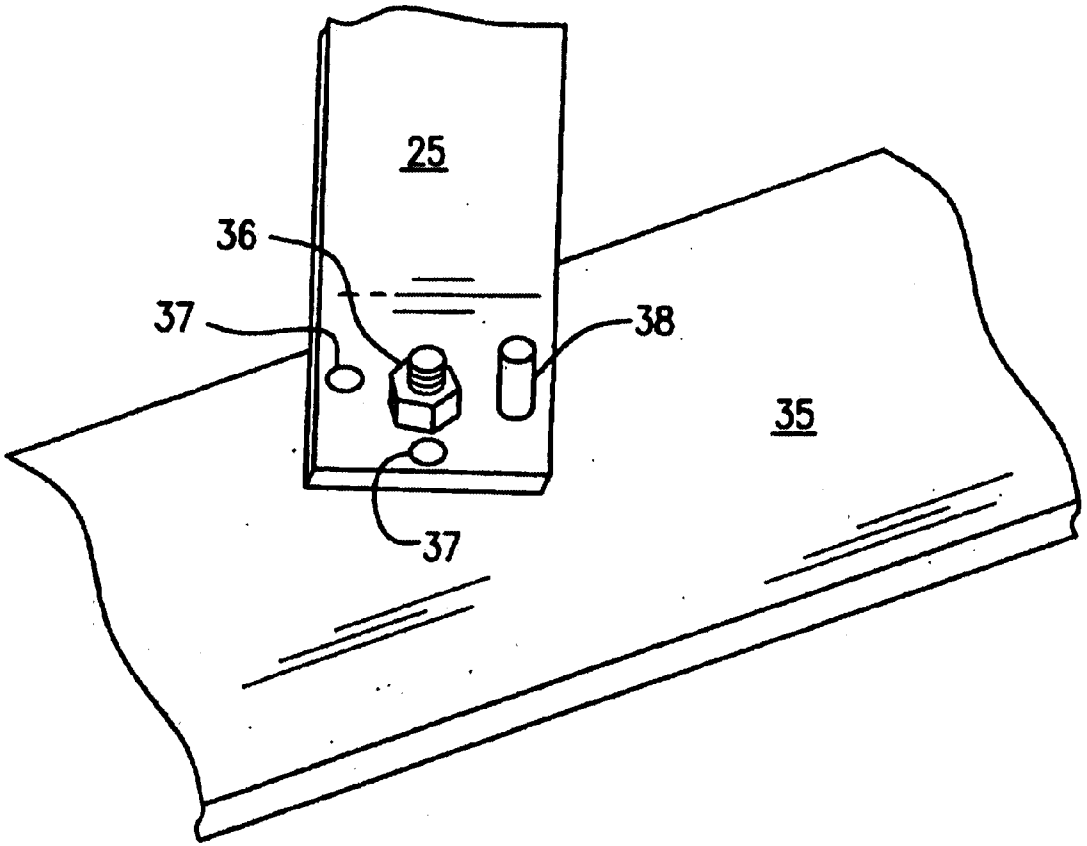
FIG. 2 is a magnified view of the joint between the bracket and support of the snow shovel of FIG. 1.

FIG. 2 illustrates the pivot joint 36 connection between the bracket 25 and support bar 35 in greater detail. As shown, the pivot joint 36 can be formed by a threaded bolt fastened through the support bar 35 and bracket 36 so as to permit rotational movement between them. When the pivot joint 36 can be non-destructively disassembled, storage of the shovel 10 is made easier, as the blade 20 can be removed to occupy less space.

Alternatively, the pivot joint 36 may be formed by a permanent connector which is arranged to permit relative movement, such as a rivet loosely joining bracket 25 and support bar 35, a bolt and locking cotter pin or a similar shaft and locking fastener combination.

Figure 3:
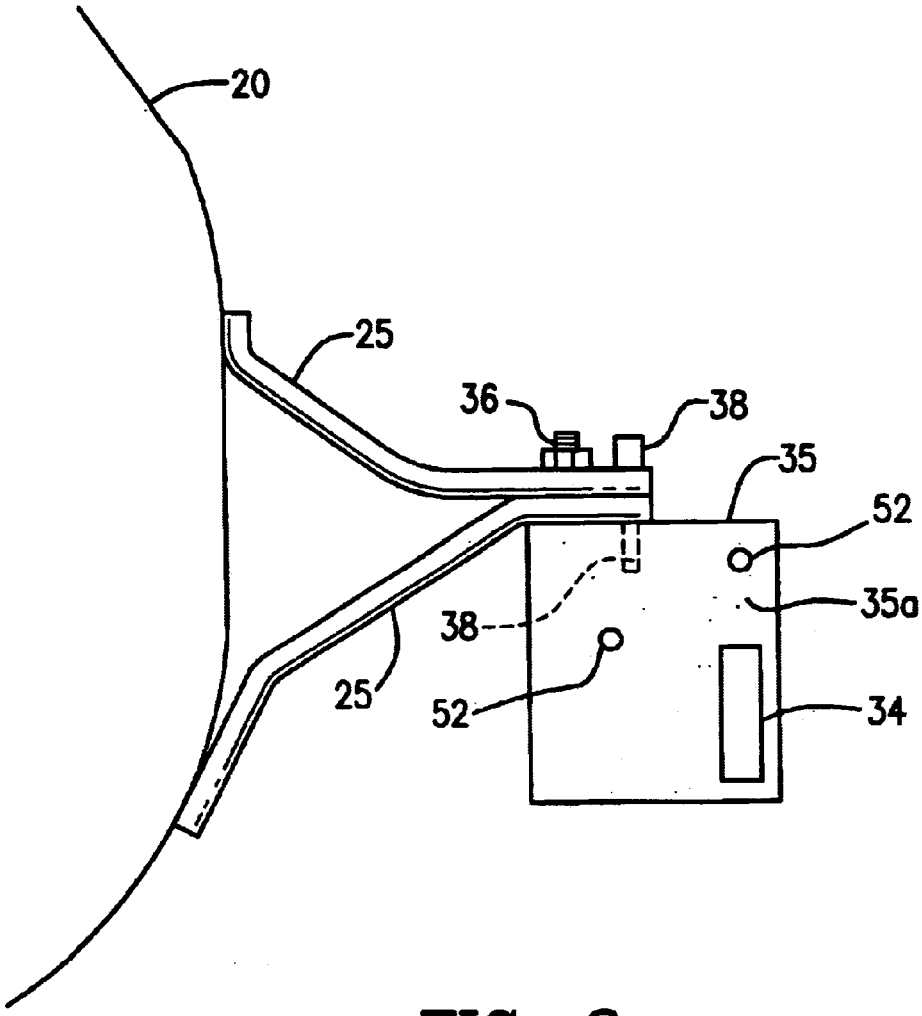
FIG. 3 is a side elevation view of the shovel of FIG. 1 with the wheels and handle removed.

The pivot joint 36 is held in a pre-determined fixed position by a locking pin 38. As best seen in FIGS. 2 and 3, a locking pin 38 is provided extending through one of the bracket holes 37 in the bracket 25 and a corresponding carriage hole in the support bar 35. The locking pin 38 has a larger head than the diameter of the bracket holes 37 so that the upper end will not pass through the bracket hole 37 it is inserted into.

A number of carriage holes through the support bar 35 are positioned to align with one or more of the bracket holes 37 when the bracket 25 and shovel blade 20 are pivoted to a particular position. The locking pin 38 is then dropped into place through an aligned pair of the bracket holes 37 and carriage holes. The locking pin 38 can be threaded at one end for fastening more securely through the aligned holes, or it may simply have a length sufficient to prevent it from rising out of the aligned holes during use. For example, an unthreaded locking pin 38 used with the shovel 10 may extend about ½ inch past the lower surface of the support bar 35.

The locking pin 38 prevents relative movement of the shovel blade 20 and carriage 30 during use. The shovel blade 20 is preferably positionable in at least three positions—left, right and center. The left and right positions orient the shovel blade 20 to push snow off to the side of the direction of travel of the carriage 30, while the center position will push snow straight ahead in advance of the shovel 10. By locking the shovel blade 20 position relative to the carriage 30, the carriage 30 can be pushed straight forward while the shovel blade remains in a fixed orientation that can be oblique to the direction of travel.

Referring again to FIG. 3, a side panel 35*a* of support bar 35 is shown having openings 34, 52 for receiving axles 32 and attaching the handle 50, respectively. The axle opening 34 is preferably slotted so that the axle 32 may be fixed at different heights to permit adjustment of the shovel 10 for differences in the blade 20 size. Alternatively, the axle opening 34 can be a simple circular opening for receiving the axle 32 and affixing the wheel 33 thereto.

The axles 32 are preferably shafts having a threaded end or hole at the end for passing through axle openings 34 and receiving a fastener such as a nut or cotter pin. The shafts permit free rotational movement of the wheels 33 in either direction, while holding them securely to the carriage 30. Washers and other elements common to such connections may be used to improve the attachment of the wheels 33 to the carriage 30.

The handle attachment openings 52 are arranged so that ends of the handle 50 can be affixed using threaded connectors. Two openings 52 are provided to lend additional strength and rigidity to the connection, while orienting the handle 50 upwardly and to the rear.

As seen in FIGS. 1 and 3, the bracket 25 can be either a single, unitary piece or two separate pieces joined together. Preferably, the bracket 25 is a single piece bent to form a generally "V"-shaped support with the free end of each arm secured to shovel blade 20. The bracket 25 preferably lends support to the shovel blade 20 as well as holding it in place and preventing tilting of the blade forward and backward. While a single arm bracket 25 could be used, it is not preferred, so as to avoid undesirable movement of the shovel blade 20 relative to the carriage 30.

The arms of bracket 25 are made sufficiently long so that the shovel blade 20 does not impinge upon the wheels 33 when the blade is pivoted to the extreme left or right lockable position. The lengths of the bracket 25 and support bar 35, width of the shovel blade 20, and the diameter of the wheels 33 will all affect the length of the bracket 25 required to use the shovel blade 20 at a particular angle relative to the direction of travel of the carriage 30. In a preferred embodiment, the wheels 33 have a diameter of about 4 inches, the support bar 35 is about 24 inches long, the shovel blade is about 30 inches wide and the support bracket 25 arms extend about 8 inches forward. The shovel blade 20 is preferably longer than the total length of the support bar 35 with the wheels 33, so that snow directly ahead of the wheels 33 is removed to avoid leaving packed snow from the wheel tracks.

The dimensions are preferably set to permit positioning the shovel blade 20 at left and right maximum angles of between 5–45°, and more preferably maximum angles between 15–35°. While the support bar 35 may have several carriage openings 39 for aligning with corresponding bracket openings 37, preferably at least three carriage openings 39 are provided for holding the bracket 25 and shovel blade 20 at three different angles relative to the support bar 35. The three angles are preferably one position being with the shovel blade 20 parallel to the support bar 35 and carriage 30 (centered), one position angled to the left at between 5–45°, and the third position angled to the right at between 5–45°. The carriage hole 39 positions to each side of center may be arranged symmetric or asymmetric, but symmetry is preferred so that the shovel is equally useful for either side.

Figure 4:
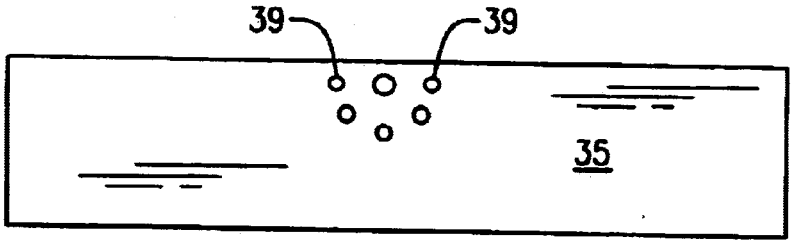
FIG. 4 is a top plan view of an alternative support for the snow shovel of FIG. 1.

FIG. 4 illustrates an embodiment of the support bar 35 having five different carriage holes 39 for aligning with the bracket holes 37 to position the shovel blade 20. The bracket 25 may include five bracket holes 37 (such shown in FIG. 5), each one aligning with a different one of the carriage holes 39. Alternatively, the carriage holes 39 may all be positioned so as to align with a single bracket hole 37 for locking with a locking pin 38.

Figure 5:
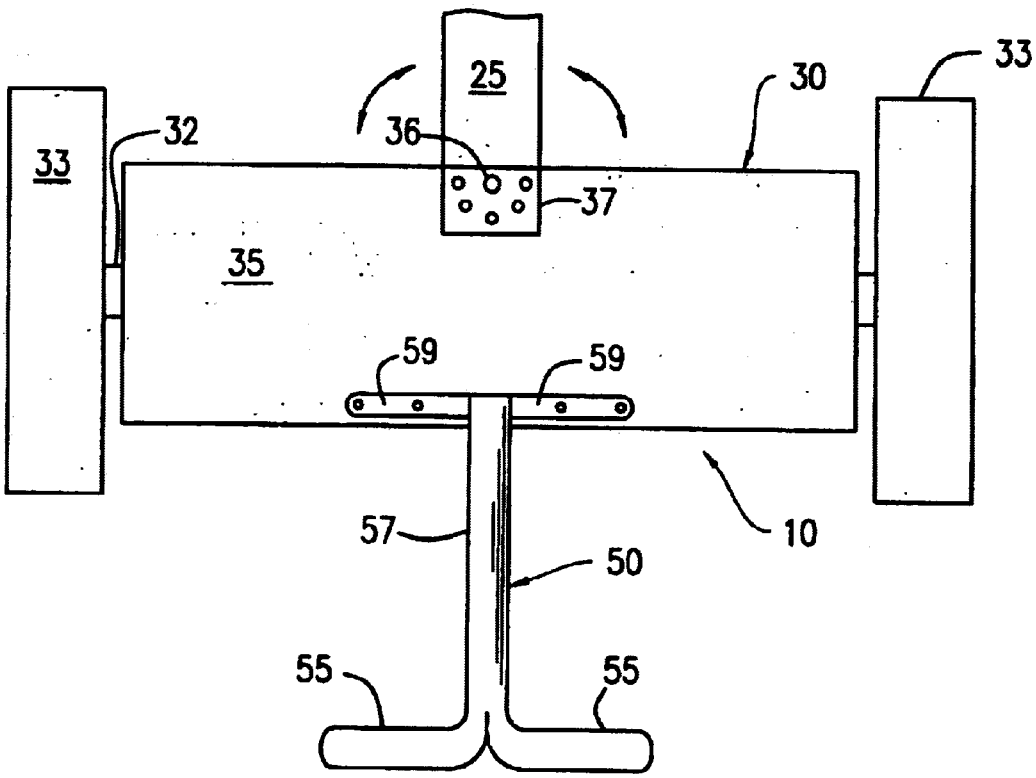
FIG. 5 is a top plan view of a second embodiment of a snow shovel according to the invention.

FIG. 5 shows an alternate embodiment of the shovel 10 in which handle 50 is connected extending from the top of support bar 35. The handle 50 has an "I" or "T" shape, with a pair of handle grips 55 extending horizontally at the far end of handle shaft 57. The bottom end of the handle 50 can be secured using wings 59 to attach to the support bar 35. In a further alternative, the handle 50 does not include the horizontal handle grips, and instead has only handle shaft 57 extending upwardly to the rear of the shovel blade 20, similar to a conventional shovel.

Figure 6:
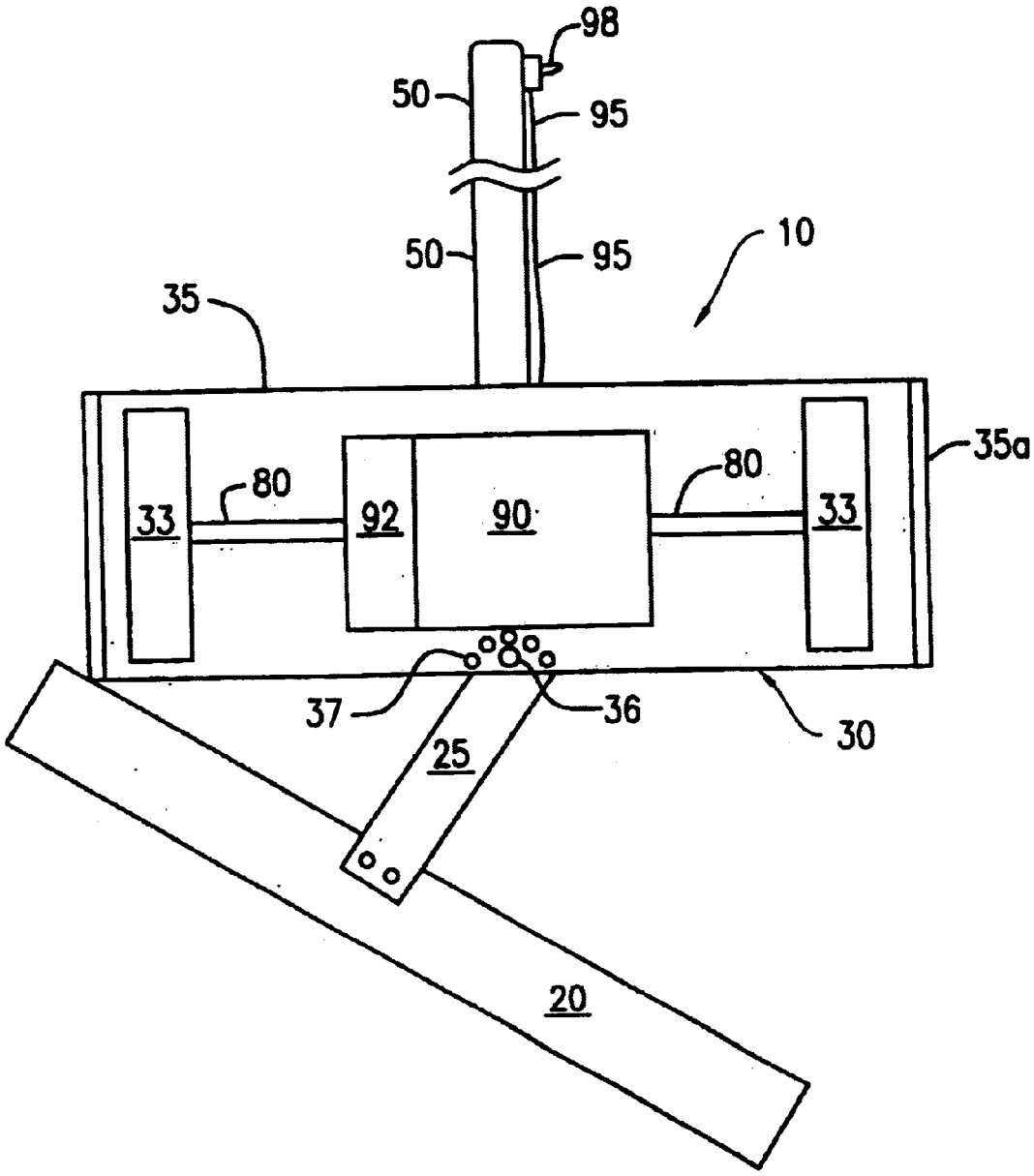
FIG. 6 is a bottom plan view of a third embodiment of a snow shovel of the invention.

A motorized version of the snow shovel 10 is illustrated in FIG. 6. The support bar 35 is shown looking at the bottom, where a motor 90 and battery 92 are mounted. A pair of wheels 33 are connected to the motor 90 by axles 80 for directly driving the wheels. The motor 90 is preferably an electric motor, but a gas powered motor may be used instead, and battery 92 can be replaced by a gas tank. The motor 90 is preferably activated by a switch 98 either mounted on the top surface of support bar 35 (not shown) or connected by a wire 95 and secured at the upper end of handle 50 for easier activation.

The self-propelled snow shovel 10 shown in FIG. 6 is easily operated by persons of any strength with minimal effort. And, unlike a snow blower, the shovel 10 does not have any whirling blades which can present a significant hazard if not used properly.

As seen in FIG. 6, wheels 33 are mounted inside the side panels 35*a* of the support bar 35. The side panels 35*a* do not need to be present when the wheels are mounted to the motor 90, but can be provided to shield the wheels 33.

As will be appreciated from the foregoing, both the manual and self-propelled versions of the shovel 10 are easily used to push snow from a driveway or walkway to the side of the area being cleared. The shovel blade 20 is oriented to one side or the other in a preferred mode of use, so as to direct snow to the so-angled side as the carriage 30 is moved straight forward. The shovel 10 permits the shovel blade 20 to be angled relative to the direction of movement without requiring a user to perform awkward movements. Similarly, a user need not strain to maintain the angled direction of the shovel blade 20 relative to the direction of travel.

The shovel 10 is easily adjusted to change the angle of the blade 20 relative to the direction of travel as well. In the preferred embodiment, the locking pin 38 is removed, the blade 20 repositioned and the pin 38 reinserted in a different pair of aligned bracket and carriage holes 37, 39.

As can be understood from the foregoing, the shovel 10 is very easily dismantled and stored or parts are easily removed and replaced. The ease of replacement for each of the parts makes the shovel 10 economical, and, by replacing parts which wear more quickly, such as the blade 20, the shovel 10 can have a long useful life. Further, the storage space occupied by the shovel 10 when it is taken apart is significantly less than when it is assembled ready for use.

It should be noted as well that while the wheels 33 are shown at the outside ends of the support bar 35 in FIGS. 1–5, they can also be mounted on axles 32 to the inside of side panels 35*a*. The side panels 35*a* or similar depending support should be made sufficiently long to accommodate the wheel diameter selected for free rotation and avoiding contact with the support bar 35.

The carriage 30 may have more than two wheels 33 as well. For example, a rectangular frame including the support bar 35 may be used to mount three or four wheels to add stability to the shovel 10.

And, although the carriage 30 is shown as being manually motivated or having its own motor 90, it is envisioned that the snow shovel blade 20 and bracket 25 can be mounted to the front of a self-propelled lawn mower. The bracket can be mounted using a support bar 35 and side panels 35*a* to position the shovel blade in a similar manner as with the wheeled carriage 30. For example, the side panels 35*a* could attach to the self-propelled lawn mower at the front wheels.

A different-tool head could be substituted for the shovel blade 20 if desired, for use in other applications. For example, a rake head, a grader or a furrowing tool could be mounted to carriage 30 instead.

While a specific embodiment of the invention has been shown and described in detail to illustrate the application of the principles of the invention, it will be understood that the invention may be embodied otherwise without departing from such principles.

What is claimed is:

1. An articulated snow shovel, comprising:

a laterally extending support bar having a pair of ends, a front and a rear;

a pair of wheels rotatably attached to each end of the support bar;

a bracket having a pair of vertically spaced apart bracket arms pivotally connected to the support bar and extending to the front of the support bar;

a shovel blade fixedly attached to the bracket arms and being pivotable with the bracket relative to the support bar;

a locking pin inserted through one of a plurality of aligned openings in each of the support bar and the bracket for locking the position of the shovel blade relative to the support bar; and a U-shaped handle having a pair of legs, one leg attached at each end of the support bar adjacent one of the pair of wheels for pushing the support bar and shovel blade in a forward direction to push snow or other material ahead of the shovel blade.

2. A snow shovel according to claim 1, wherein the openings in the support bar comprise carriage openings, there being at least three carriage openings in the support bar.

3. A snow shovel according to claim 2, wherein the openings in the bracket comprise bracket openings, there being at least three bracket openings in the bracket.

4. A snow shovel according to claim 3, wherein each of the at least three carriage openings is positioned to align with one of the at least three bracket openings for inserting the locking pin therethrough.

5. A snow shovel according to claim 1, wherein the shovel blade is pivotable to form a maximum angle of up to 45° with the support bar.

6. A snow shovel according to claim 1, wherein the U-shaped handle and bracket are each detachable from the support bar for storage.

7. A snow shovel according to claim 1, further comprising motor means mounted to the support bar for driving the wheels.

8. A snow shovel according to claim 7, wherein the motor means comprises an electric motor, a battery electrically connected to power the electric motor and axles extending from the electric motor carrying the wheels.

9. A snow shovel according to claim 7, further comprising a switch for activating or deactivating the motor means.

* * * * *